US009515404B2

(12) United States Patent
Hoefner et al.

(10) Patent No.: US 9,515,404 B2
(45) Date of Patent: Dec. 6, 2016

(54) ELECTRICAL CONTACT PLUG AND PLUG HOUSING

(71) Applicant: LEONI BORDNETZ-SYSTEME GMBH, Kitzingen (DE)

(72) Inventors: Achim Hoefner, Oldenburg (DE); Tanil Gezgin, Oldenbrok/Ovelgoenne (DE)

(73) Assignee: Leoni Bordnetz-Systeme GmbH, Kitzingen (DE)

( * ) Notice: Subject to any disclaimer, the term of this patent is extended or adjusted under 35 U.S.C. 154(b) by 3 days.

(21) Appl. No.: 14/658,655

(22) Filed: Mar. 16, 2015

(65) Prior Publication Data

US 2015/0263445 A1 Sep. 17, 2015

Related U.S. Application Data

(63) Continuation of application No. PCT/EP2013/002560, filed on Aug. 26, 2013.

(30) Foreign Application Priority Data

Sep. 15, 2012 (DE) ..... 20 2012 008 868 U

(51) Int. Cl.
*H01R 13/405* (2006.01)
*H01R 13/52* (2006.01)
*H01R 13/56* (2006.01)

(52) U.S. Cl.
CPC ..... *H01R 13/405* (2013.01); *H01R 13/521* (2013.01); *H01R 13/5205* (2013.01); *H01R 13/562* (2013.01)

(58) Field of Classification Search
CPC ..... H01R 13/5205; H01R 13/521; H01R 13/405; H01R 13/562
USPC ..... 439/660, 271, 275, 587, 604
See application file for complete search history.

(56) References Cited

U.S. PATENT DOCUMENTS 5,120,268 A * 6/1992 Gerrans ..... H01R 13/523 439/278
5,580,264 A 12/1996 Aoyama et al.
5,724,730 A * 3/1998 Tanaka ..... B29C 45/14639 174/76
6,161,282 A * 12/2000 Nieslony ..... B29C 45/14639 264/272.11
6,794,574 B2 * 9/2004 Gust ..... H02G 15/04 16/2.1
8,784,119 B2 * 7/2014 Tseng ..... H01R 12/63 439/495

FOREIGN PATENT DOCUMENTS

EP 0 696 827 A2 2/1996
JP S5155392 U 4/1976

* cited by examiner

*Primary Examiner* — Edwin A. Leon
(74) *Attorney, Agent, or Firm* — Laurence A. Greenberg; Werner H. Stemer; Ralph E. Locher

(57) ABSTRACT

An electrical contact plug has a cable with a plurality of conductor cores connected thereto. A plug housing extends in the longitudinal direction and extends from a front contact region up to a rear insertion region. The cable is introduced into the plug housing in the rear insertion region and is surrounded by an injection-molded encapsulation. In order to avoid reliably the ingress of injection-molding compound into the front contact region during the injection-molding operation, the plug housing has a conical receptacle in the rear insertion region, with a cone element being formed as insert part in said conical receptacle, through which cone element the conductor cores are passed individually. Reliable and safe sealing of the conductor cores with respect to the contact region is performed via the cone element.

12 Claims, 2 Drawing Sheets

ELECTRICAL CONTACT PLUG AND PLUG HOUSING

BACKGROUND OF THE INVENTION

Field of the Invention

The invention relates to an electrical contact plug having a cable connected thereto with a plurality of line cores, comprising a plug housing which extends in the longitudinal direction and which includes a front contact region having contact elements inlaid therein and a rear insertion region in which the line cores are inserted. The cable is surrounded in the insertion region by an insertion-molded encapsulation. The plug housing (6) includes a conical receptacle in the insertion region into which a corresponding conical element is inlaid as an inlay part through which the line cores are individually routed. The conical element seals the plug housing in relation to the contact region. The invention also pertains to a plug housing and conical element for an electrical contact plug, wherein the plug housing extends in a longitudinal direction and comprises a front contact region for contact elements, as well as a rear insertion region for inserting a cable having a plurality of individual cores. The plug housing in the insertion region forms itself a conical receptacle for the conical element which includes lead-throughs for individually leading through the line cores in a sealed manner.

A contact plug of this type as well as a plug housing of this type are disclosed in EP 0 696 827 A2.

In contact plugs of this type either socket contacts or male contacts are typically disposed as contact elements in the front contact region which is configured as a contact carrier. In order to achieve adequate sealing, the plug housing at the cable-side end face is surrounded with the insertion-molded encapsulation. The insertion-molded encapsulation here is usually configured after fabrication of the contact plug, that is to say after inlaying the individual line cores with the contact elements affixed thereon into the plug housing. During insertion molding the pre-fabricated plug is inlaid into the corresponding mold into which the molding compound is then introduced for configuring the insertion-molded encapsulation. Here the problem exists that the molding material, which in its processing state may be highly fluid, may make its way into the contact region having the contact elements inlaid therein.

EP 0 696 827 A2 discloses the use of a separate conical element by way of which the individual line cores are routed in an individual manner. The conical element here is completely inlaid in a corresponding conical receptacle in the plug housing. On account of the injection pressure during the application of the injection compound for configuring the insertion-molded encapsulation, the conical element is compressed farther into the conical receptacle, on account of which sealing is achieved and penetration of the injection compound into the plug housing is to be prevented.

BRIEF SUMMARY OF THE INVENTION

The invention is based on the object of providing an improved electrical contact plug.

The object is achieved according to the invention with an electrical contact plug having the features as claimed. In order to securely seal the contact region in preparation for insertion molding, the rear insertion region of the plug housing is widened in a conical manner toward the cable-side end face. A corresponding conical element is inlaid as an inlay part, in which the line cores are individually routed, in this conical portion. The conical element here seals the plug housing in relation to the contact region. On account of the conical design, automatic and reliable sealing between the inner wall of the plug housing and the outer wall of the conical element is achieved in a reliable manner such that no risk of injection-molding material penetrating the front contact region exists. On account of the individual routing of the line cores through the conical element, said line cores may also be reliably sealed in a simple manner in the longitudinal direction.

The outer wall of the conical element expediently bears immediately on the inner wall of the plug housing, such that a first sealing face is thus configured between the outer wall and the inner wall. Therefore, no further sealing element is required. The conical element and the plug housing preferably are composed of plastic, the same material being used for both elements. Alternatively, there is also the possibility for the conical element here to be configured from a somewhat softer plastic material than the plug housing.

On account of the conical design, the particular advantage is achieved that during assembly the conical element is compressed in the radial direction, that is to say perpendicular to the longitudinal direction, when the conical element is inserted into the conical receptacle, such that a reliable and secure seal is configured between the inner wall of the plug housing and the outer wall of the conical element, on the one hand, and between the core insulation and the conical element, on the other hand.

In order to achieve reliable sealing the conical element includes a rearward rear end which in the longitudinal direction projects rearward beyond the plug housing and which is surrounded by the insertion-molded encapsulation. In addition to the first sealing face between the outer wall of the conical element and the inner wall of the plug housing in the insertion region, further sealing in relation to environmental influences (splash water etc.) is thereby established by the insertion-molded encapsulation per se.

The conical element includes on its outer wall a first profile feature, in particular an encircling annular groove, for a mechanically secure connection of the insertion-molded encapsulation. The injection material thus penetrates into the annular groove, such that a form fit which is effective in the longitudinal direction is configured.

Additionally, the insertion-molded encapsulation also at least in part surrounds the rear insertion region. The insertion-molded encapsulation thus encloses the plug housing in a somewhat cup-shaped manner to provide efficient sealing.

Furthermore, the insertion region on its outer wall includes a second profile feature for configuring the form-fitting connection to the insertion-molded encapsulation. This profile feature expediently is formed by a plurality of encircling annular webs. On account of the two profile features on the conical element, on the one hand, and on the plug housing, on the other hand, in addition to the insertion-molded encapsulation, form-fitting meshing of the conical element with the plug housing is thus achieved by way of the insertion-molded encapsulation.

In order to seal the line cores, the conical element expediently includes lead throughs for the individual line cores, in which the latter are individually inlaid. A second sealing face is directly formed between the inner wall of the lead through and the outer sleeve of the respective line core. Here too, the line cores thus lie having a perfect fit immediately in the lead throughs, without further sealing elements or other sealing measures.

When viewed in the longitudinal direction, each lead through here includes a plurality of portions. Besides the insertion duct, each lead through additionally includes at least one lead-through opening, preferably a plurality thereof, configured on a cross brace which runs transversely to the longitudinal direction. On account thereof, multiple-step sealing of the line core in relation to the conical element is effected.

With a view to assembly being as simple as possible, the conical element expediently is configured from two half-shells. In contrast thereto, the plug housing usually is configured in one part into which the conical element is plugged in from the rear.

In an expedient refinement in the sense of a common-part concept having as low a number of components as possible, the two half-shells preferably are configured so as to be identical.

With a view to assured assembly the conical element in the rearward region displays a marking which is formed in particular by the already mentioned encircling annular groove. In the state of final assembly, the conical element is inserted into the plug housing up to this marking. This marking serves for improving assured assembly, since the correct axial position of the conical element within the plug housing is identifiable by way of said marking. On account thereof, secure sealing on both sealing faces is ensured.

The object is furthermore achieved according to the invention by a plug housing with a conical element, having the features as claimed. A plug housing of this type with a conical element serves for configuring the electrical contact plug described above, having the insertion-molded encapsulation for sealing in relation to environmental influences.

BRIEF DESCRIPTION OF THE SEVERAL VIEWS OF THE DRAWING

An exemplary embodiment of the invention will be explained in more detail herebelow by means of the figures in which.

In the figures, parts with similar functions are provided with the same reference sign.

DESCRIPTION OF THE INVENTION

Figure 1:
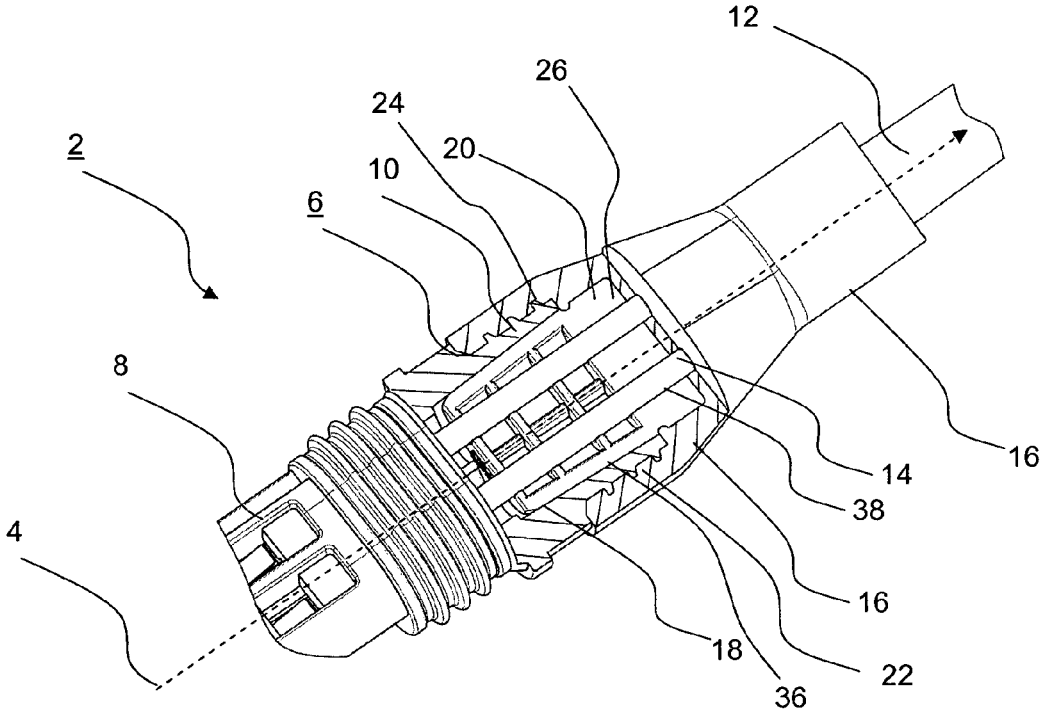
FIG. 1 shows a detail of a perspective illustration of a contact plug, in part in the cross section, wherein the sectional plane lies in the mold-parting line of the conical element.
Figure 2:
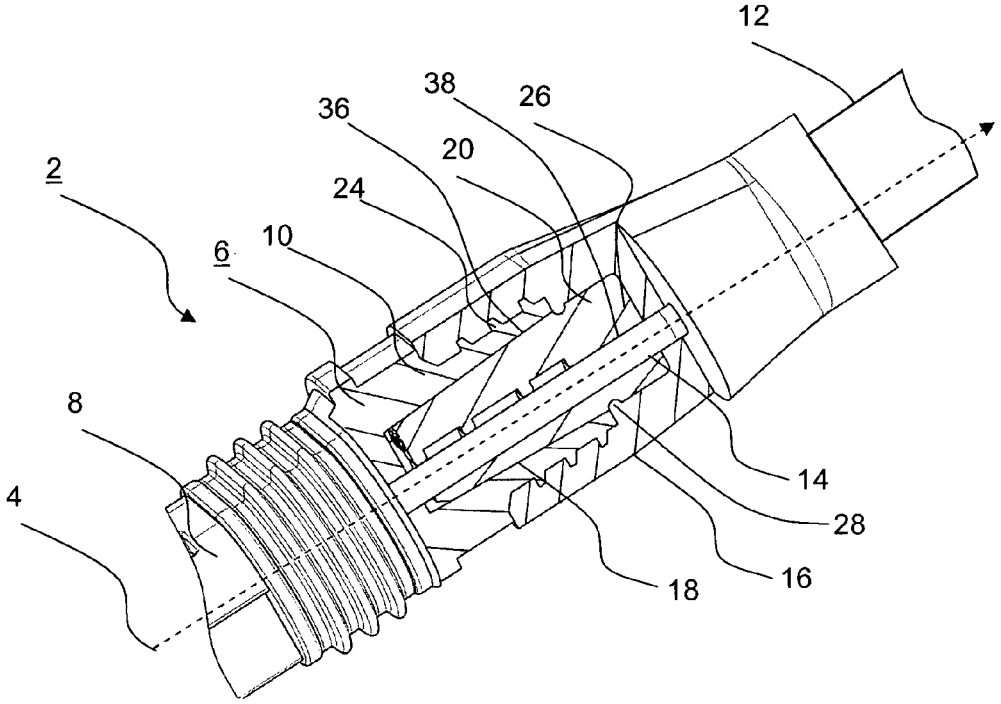
FIG. 2 shows an illustration which is similar to FIG. 1, wherein the sectional plane runs perpendicularly to the mold-parting line of the conical element.

The electrical contact plug 2 which is illustrated in FIGS. 1 and 2 extends in the longitudinal direction 4 and includes a plug housing 6 which extends from a front contact region 8 up to a rear insertion region 10. A multi-core cable 12 which is configured as a light plastic-sheathed cable with a plurality of line cores 14 is connected to the contact plug 2. The line cores 14 are surrounded by a cable sleeve. The line cores 14 in each case form one individual line and are composed of an electric conductor, for example a stranded wire, as well as of a core insulation which surrounds the conductor.

The plug housing 6 in the rear insertion region 10 is surrounded by an insertion-molded encapsulation 16 which insulates the cable 12 in relation to the plug housing 6.

The line cores 14 are routed in the longitudinal direction through the plug housing 6 up to the front contact region 8, where a respective line core 14 is in each case connected to a contact element which is not identifiable in more detail here.

The rear insertion region 10 includes a conical receptacle 18 which widens in the longitudinal direction toward a rearward end of the plug housing 6 and in which the conical element 20 configured as an inlay part is inlaid having a perfect fit. The conical receptacle 18 and the conical element 20 thus have the same cone angle.

In the rear insertion region 10 the plug housing 6, on the outer side, has a recess 22 which is configured in the manner of a step, wherein the front end of the step which is oriented toward the contact region 8 defines a stop and a delimitation of the insertion-molded encapsulation 16. Encircling annular webs 24 which are encompassed in a form-fitting manner by the insertion-molded encapsulation 16 are configured within the recess on the outer side of the plug housing.

Figure 3:
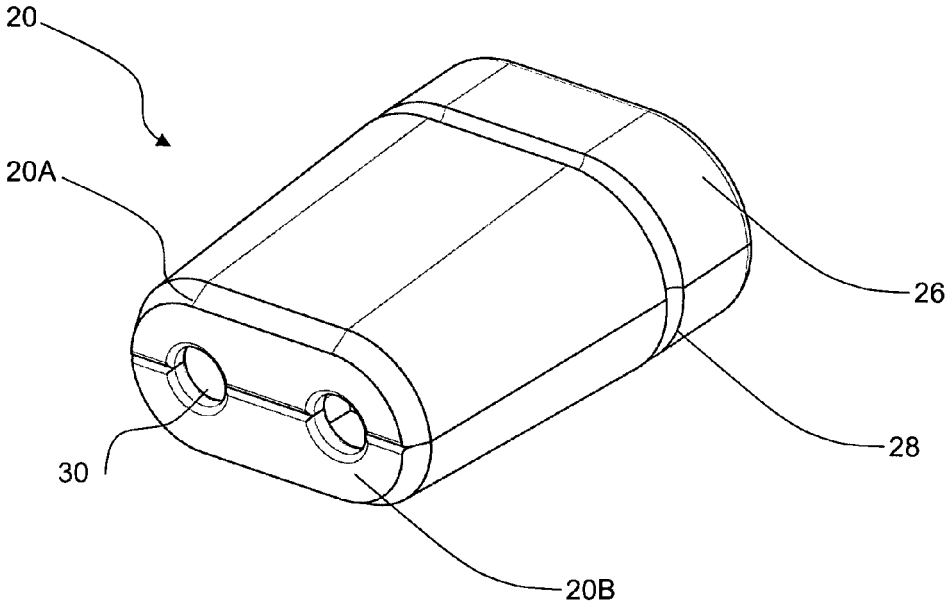
FIG. 3 shows a perspective illustration of the conical element.
Figure 4:
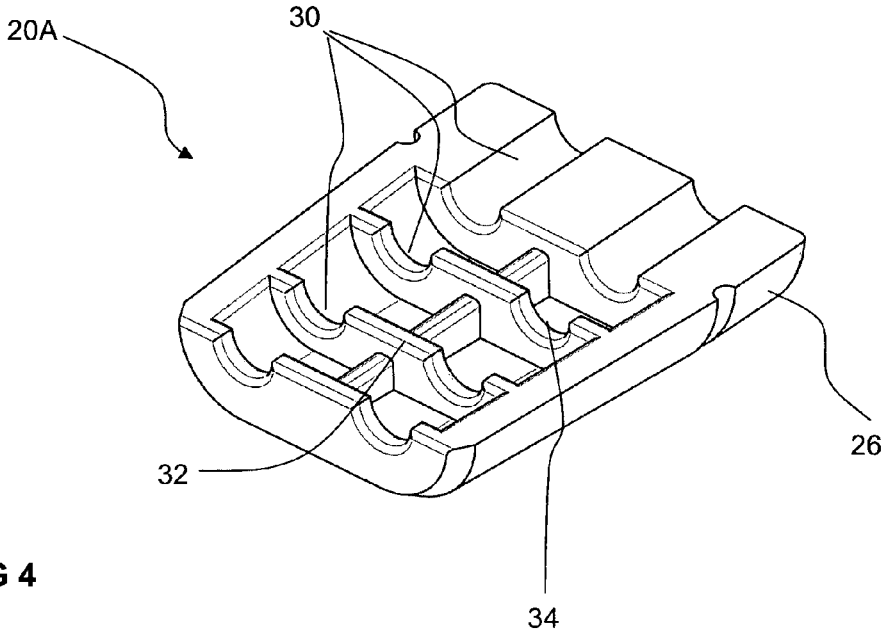
FIG. 4 shows a perspective illustration of a half-shell of the conical element.

The conical element 20, the design of which is derived in particular from FIGS. 3 and 4, in the exemplary embodiment is configured by two half-shells 20A, 20B. The conical element 20 includes a rearward rear end 26 which in the assembled state protrudes beyond the plug housing 6. An encircling annular groove 28 separates the rear end 26 from a front part-region of the conical element 20. The encircling annular groove 28 forms a marking as an aid in assembly. At the same time this annular groove 28, in the state of final assembly, together with the insertion-molded encapsulation 16 configures a form-fitting connection.

In its interior the conical element 20 includes a plurality of lead throughs 30 which are disposed so as to be beside one another within the mold-parting line of the two half-shells 20A, 20B. Two lead throughs 30 are illustrated in the exemplary embodiment; however, there may also be more thereof. As an alternative to the singularized line cores 14 other types of line, such as ribbon cables, for example, may also be led through, in which case the lead throughs 30 are configured in a correspondingly adapted manner. In the region of the rear end 26 a respective lead through 30 firstly includes an insertion duct, the length of which extends across the axial length of the rear end 26. A plurality of cross braces 32 which in each case define lead-through openings 34 for the individual line cores 14 are configured toward the contact region 8. Cavities are in each case configured between the individual cross braces 32. As can be seen in particular from the partly sectional side view according to FIG. 2, the cross braces 32 are configured merely in one of the half-shells 20A, whereas the line cores 14 bear on the other half-shell 20B across the entire length of the conical element 20.

In the assembled final state as illustrated in FIGS. 1 and 2 the conical element 20 is inlaid having a perfect fit in the conical receptacle 18. Moreover, on account of the conicity, a radial contact pressure is exerted, such that a first sealing face 36 is configured between the inner wall of the plug housing 6 and the outer wall of the conical element 20. At the same time a second sealing face 38 is configured between a respective inner wall of the lead throughs 30 and the respective core insulation of the line cores 14, in particular in the region of the insertion ducts in the region of the rear end 26. Additionally, the wall portions of the lead-through openings 34 are somewhat force-fitted into the core insulation in the region of the cross braces 32. On account of this conical design, overall secure and reliable sealing of the plug housing 6 in relation to the front contact region 8 is achieved. On account of the conical element 20, it is thus reliably avoided that injection material makes its way into the front contact region 8 during the injection-molding operation for attaching the insertion-molded encapsulation 16.

During the assembly process the individual cores 14 are inlaid into the conical element 20 by their contact elements which are affixed at the front end. Said conical element 20 is subsequently inserted from the rear in the longitudinal direction 4 up to the encircling annular groove 28 into the receptacle 18. The annular groove 28 marks a final assembly position at which the conical element 20 is inlaid in the conical receptacle 18, having a perfect fit in the manner of a tight fit. At this assembly position the conical element 30 is reliably sealed in relation to the receptacle 18. At the same time the respective core insulation of the individual line cores 14 is also sealed. It is particularly advantageous here that the line cores 14 are not or at least only insignificantly compressed in the longitudinal direction. Also, a desirable freedom of contacting movement of the contact elements in the contact region 18 is maintained.

As an alternative to the preferred one-part design of the plug housing 6, the latter may also be configured in multiple parts, for example from two half-shells which are connected to one another by latching. The conical element 20 having the line cores 14 inlaid therein may also be firstly inlaid in one of the half-shells of the plug housing 6, in the manner of a pre-assembly position, the plug housing 6 being subsequently closed.

The entire assembly operation can be performed manually as well as by machine.

In the next method step the insertion-molded encapsulation 16 is then configured. To this end, the pre-fabricated plug housing 6 having the conical element 20 inlaid therein and the already connected cable 12 are inlaid into a corresponding (injection-molding) die, and the injection compound is subsequently injected into the molding tool. After curing the contact plug 2, which is completely assembled at this point, is demolded again.

By way of the variant of embodiment of an electrical contact plug 2 having the conical element 20 as described herein, simple and cost-effective assembly and at the same time good sealing in the longitudinal direction are achieved. The individual parts can be produced in a comparatively simple and thus cost-effective manner, also resulting in low tooling costs. The variant of embodiment described herein may be economically employed for both large volumes in mass production as well as for very small batches. Moreover, on account of the inlaid conical element 20, comparatively short plug lengths can also be configured. The cable 12 may be connected in the longitudinal direction 4 or else at an angle. The configuration of a straight as well as an angulated plug is readily possible. When configuring an angulated plug, the conical element 20 is configured so as to be angulated, for example. Moreover, a particular advantage in the manufacturing operation can be seen in that merely a single injection-molding operation and no multiple insertion-molding encapsulations or a multi-step injection-molding operation are required. Also, no additional sealing elements are required. Sealing is performed by the conical element 20 alone. The latter, like the plug housing 6, is configured from plastic.

LIST OF REFERENCE SIGNS

2 Electrical contact plug
4 Longitudinal direction
6 Plug housing
8 Contact region
10 Rear insertion region
12 Cable
14 Line core
16 Insertion-molded encapsulation
18 Conical receptacle
20 Conical element
20A,B Half-shell
22 Recess
24 Annular web
26 Rear end
28 Annular groove
30 Lead through
32 Cross brace
34 Lead-through opening
36 First sealing face
38 Second sealing face

The invention claimed is:

1. An electrical contact plug having a cable with a plurality of line cores connected thereto, the plug comprising:

a plug housing extending in a longitudinal direction and having a front contact region with contact elements inlaid therein and a rear insertion region in which the line cores of the cable are inserted, wherein the cable is surrounded by an insert-molded encapsulation at said rear insertion region of said plug housing;

said plug housing being formed with a conical receptacle in said insertion region;

a conical element forming an inlay part in said conical receptacle and having the line cores individually routed therethrough, said conical element sealing said plug housing in relation to said contact region;

said conical element including a rearward rear end projecting rearward in the longitudinal direction beyond said plug housing and having a first profile feature; and said rear insertion region of said plug housing being formed with a second profile feature, and said insert-molded encapsulation surrounding said rear end of said conical element and said rear insertion region of said plug housing, with said first and second profile features forming a positive connection with said insert-molded encapsulation.

2. The contact plug according to claim 1, wherein a first sealing face is configured immediately between said receptacle and said conical element.

3. The contact plug according to claim 1, wherein said conical element is formed with leadthroughs for said line cores, with one of said line cores laid in each of said leadthroughs, and said second sealing face is formed immediately between said leadthrough and said line core.

4. The contact plug according to claim 1, wherein said conical element has at least one cross brace that extends transversely to the longitudinal direction and that has a plurality of leadthrough openings in which in each case one of said line cores is inlaid.

5. The contact plug according to claim 1, wherein said conical element is configured from two half-shells.

6. The contact plug according to claim 5, wherein said half-shells are mutually identical half-shells.

7. The contact plug according to claim 1, wherein said first profile feature is an encircling annular groove.

8. The contact plug according to claim 1, wherein the plug housing in said rear insertion region is formed with a recess in a radial direction.

9. The contact plug according to claim 1, wherein said second profile feature is a plurality of encircling annular webs.

10. The contact plug according to claim 1, wherein said conical element in the rearward region has a marking up to which said conical element is inserted into said plug housing.

11. The contact plug according to claim 10, wherein said marking is an encircling annular groove.

12. A plug housing assembly for an electrical contact plug, the assembly comprising:

a plug housing defining a longitudinal direction and having a front contact region for contact elements and a rear insertion region for insertion of a cable with a plurality of individual cores, said plug housing having a conical receptacle formed in said insertion region;

a conical element configured for placement in said conical receptacle, said conical element being formed with leadthroughs for individually leading through the line cores in a sealed manner;

said conical element having a rearward rear end projecting in the longitudinal direction rearward beyond said plug housing and having a first profile feature; and said rear insertion region of said plug housing having a second profile feature; and said first and second profile features being configured for forming a form-fitting connection with an insert-molded encapsulation.

* * * * *